US007854809B2

(12) United States Patent
Arrell et al.

(10) Patent No.: US 7,854,809 B2
(45) Date of Patent: Dec. 21, 2010

(54) HEAT TREATMENT SYSTEM FOR A COMPOSITE TURBINE ENGINE COMPONENT

(75) Inventors: Douglas J. Arrell, Oviedo, FL (US); Allister W. James, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 532 days.

(21) Appl. No.: 11/784,985

(22) Filed: Apr. 10, 2007

(65) Prior Publication Data

US 2008/0251165 A1 Oct. 16, 2008

(51) Int. Cl.
*C21D 8/02* (2006.01)
*C21D 6/02* (2006.01)

(52) U.S. Cl. ..... 148/530; 148/622

(58) Field of Classification Search ..... None
See application file for complete search history.

(56) References Cited

U.S. PATENT DOCUMENTS

| | | | | |
|---|---|---|---|---|
| 3,871,928 | A | 3/1975 | Smith, Jr. et al. | |
| 3,898,109 | A | 8/1975 | Shaw | |
| 3,982,972 | A | 9/1976 | Iwata et al. | |
| 4,323,399 | A | 4/1982 | Dubost et al. | |
| 4,394,194 | A | 7/1983 | Satava et al. | |
| RE33,186 | E | 3/1990 | Mori et al. | |
| 5,059,257 | A | 10/1991 | Wanner et al. | |
| 5,183,635 | A * | 2/1993 | Kerry et al. | 420/420 |
| 5,516,381 | A | 5/1996 | Kawai et al. | |
| 5,599,408 | A | 2/1997 | Fujita et al. | |
| 6,053,995 | A | 4/2000 | Tanibuchi et al. | |
| 6,099,668 | A | 8/2000 | Ueta et al. | |
| 6,182,439 | B1 * | 2/2001 | Siga et al. | 60/39.182 |
| 6,245,163 | B1 | 6/2001 | Yonezawa et al. | |
| 2002/0074066 | A1 | 6/2002 | Brenner et al. | |
| 2004/0092334 | A1 | 5/2004 | Yamamoto | |
| 2004/0140026 | A1 | 7/2004 | Kamat et al. | |
| 2005/0133119 | A1 * | 6/2005 | Hammond et al. | 148/220 |
| 2006/0118215 | A1 | 6/2006 | Hirakawa et al. | |

FOREIGN PATENT DOCUMENTS

| | | |
|---|---|---|
| EP | 0625586 A1 | 11/1994 |

* cited by examiner

*Primary Examiner*—Roy King
*Assistant Examiner*—Yoshitoshi Takeuchi

(57) ABSTRACT

A heat treatment process for a component of a turbine engine formed from multiple materials, such as steel and nickel. The heat treatment process includes two stages: a first stage for austinitizing the steel and solutioning the nickel, and a second stage for ageing and tempering the materials. The heat treatment process may include heating a component formed from a steel portion and a nickel portion such that the steel portion austinitizes and the nickel portion undergoes solutioning, cooling the component to prevent the excessive formation of gamma prime (γ̇), and subjecting the component to a temper heat treatment during which martensite tempering occurs.

17 Claims, No Drawings

HEAT TREATMENT SYSTEM FOR A COMPOSITE TURBINE ENGINE COMPONENT

FIELD OF THE INVENTION

This invention is directed generally to turbine engines, and more particularly to manufacturing methods for turbine rotors and disks that are usable in turbine engines and that are formed from steel and nickel.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. Typically, turbine vanes extend from a rotor. Components of the rotor are often formed from tempered martensitic steel and forged nickel-based super alloys. The heat treatment processes required for optimizing the mechanical properties of the two different materials are different. For instance, tempered martensitic steels require a two stage heat treatment producing austenite at high temperatures. The austenite is then transformed into martensite during cooling. The martensite is then tempered at an intermediate temperature producing the optimum mechanical properties. On the other hand, forged nickel-based superalloys are typically solutioned at a temperature close to the solvus at which 100 percent of the gamma prime (ỳ) phase is dissolved. The nickel superalloy is then subjected to a two stage ageing treatment in which a bimodal distribution of ỳ phase is produced. Creating a component formed of steel and nickel has necessitated that each material be treated prior to being combined. However, the individual treatment processes are costly and time consuming. Thus, a need exists for a more efficient treatment system for a turbine engine component form from a steel portion and from a nickel portion.

SUMMARY OF THE INVENTION

This invention is directed to a method of heat treatment for forming a component of a turbine engine such as a rotor or disk. The method consists of heat treating a component that is formed from two or more materials, such as, but not limited to, steel and nickel. The heat treatment method includes a two stage heat treatment process in which the degree of solutioning of the nickel alloy is reduced compared to conventional processes such that the first stage of the process is compatible with the austinitizing temperature of the steel. The second stage may be an aging or tempering stage in which the component may be heated for a limited time before undergoing cooling.

The method of heat treatment for forming a component of a turbine engine may include heating a component formed from a steel portion and a nickel portion such that the steel portion austinitizes and the nickel portion undergoes solutioning, cooling the component sufficiently fast enough to prevent the formation of excessively large ỳ, and then subjecting the component to a temper heat treatment during which martensite tempering occurs and fine gamma prime precipitates. The component may additionally be cooled after the temper heat treatment via air cooling or other appropriate method.

The component may be cooled by exposing the component to an air cool system, to a fast gas cool, or to an oil quench. When heating the component formed from a steel portion and a nickel portion such that the steel portion austinitizes and the nickel portion undergoes solutioning, the component may be heated between about 1200K and 1500K for about four hours. Cooling the component to prevent the excessive formation of ỳ or other hardening phases in the superalloy such as δ (δ) phase or γ" (γ double prime), may include a fast gas cool to a temperature of the component below about 600K. When the component is subjected to a temper heat treatment, the component may be subjected to temperatures between about 800K and 950K for at least two hours, such as in one embodiment about four hours, or at least 16 hours. In another embodiment, subjecting the component to a temper heat treatment during which martensite tempering occurs includes heating the component to a temperature of between about 1000K and about 1150K for about eight hours.

In some embodiments, the method may also include forming the turbine component from steel and nickel. The method may additionally include applying heat locally to at least one portion of the turbine component after subjecting the component to a temper heat treatment during which martensite tempering occurs.

In one embodiment, the method of heat treatment for forming a component of a turbine engine may include heating a component formed from a steel portion and a nickel portion for about four hours between about 1200K and about 1500K such that the steel portion austinitizes and the nickel portion undergoes solutioning, cooling the component via a fast gas cool to below about 600K to prevent the excessive formation of ỳ, subjecting the component to a temper heat treatment to at least about 1077K for eight hours during which martensite tempering occurs, and subjecting the component to air cooling.

In another embodiment, the method heat treatment for forming a component of a turbine engine may include heating a component formed from a steel portion, an intermediate alloy portion, and a nickel portion for about four hours between about 1200K and about 1500K such that the steel portion austinitizes and the nickel portion undergoes solutioning, cooling the component via an oil quench to prevent the excessive formation of ỳ or other hardening phases, subjecting the component to a temper heat treatment to about 1023K for four hours during which martensite tempering occurs, and subjecting the steel portion to air cooling during additional heating of the nickel portion for an additional twelve hour period at 1023K.

An advantage of this invention is that the method subjects a component formed of steel and nickel to a two stage heat treatment process that produces austenite in the steel, which is transformed into martensite when cooled, and then tempered to produce optimum mechanical properties in the steel. Simultaneously, the nickel is solutioned to dissolve the ỳ phase during the first stage and undergoes a bimodal distribution of the ỳ phase during the second stage aging heat treatment to yield superior mechanical properties in the nickel.

Another advantage of this invention is that the method of treating the steel and nickel simultaneously when formed in the same component provides a reduced cost, high mechanical property component compared with conventional treatment methods.

Still another advantage of this heat treatment process is that the process allows the entire multi-alloy component to be optimally heat treated.

These and other embodiments are described in more detail below.

DETAILED DESCRIPTION OF THE INVENTION

This invention is directed to a method of heat treatment for forming a component of a turbine engine. The method consists of heat treating a component that is formed from two or more materials, such as, but not limited to, steel and nickel. The heat treatment method includes a two stage heat treatment process in which the degree of solutioning of the nickel alloy is reduced compared to conventional processes such that the first stage of the process is compatible with the austinitizing temperature of the steel. The second stage may be a combined ageing and tempering stage in which the component may be heated for a limited time before undergoing cooling.

The component may be formed from materials, such as, but not limited to steel and nickel. In at least one embodiment, the component may be formed from steel, an intermediate alloy, and nickel. The steel may be, but is not limited to, 3.5 NiCrMoV 2.5% Cr rotor steel, P92 or E911 rotor steel, and the nickel may be, but is not limited to, UDIMET 720 or WASPALOY. The intermediate alloy may be, but is not limited to, NIMONIC 901. The component may be formed into a gas or steam turbine rotor or disk. Part of the disk may be steel with the remainder being a nickel based alloy. In one embodiment, the disk may be formed from a bore of steel with a superalloy rim. In another embodiment, the disk may be formed from a bore of steel, an intermediate nickel or iron based superalloy and a rim of a high strength superalloy. The component may be formed before this process. Alternatively, this method may include the formation of the component from the materials previously identified.

The component may be heated such that the steel portion austinitizes and the nickel portion undergoes solutioning during its first stage. In such heating process, the solutioning process of the nickel alloy may be reduced relative to conventional systems to be compatible with the austinitizing temperature of the steel. For instance, the component may be heated to a temperature between about 1200K and 1500K for about 4 hours.

The component may then be subjected to cooling to prevent the excessive formation of ỳ. The component may be cooled with an air cool system, a fast gas cool (forced inert gas cooling), an oil quench, or other appropriate cooling method. The cooling rate of the fast gas cool should be sufficiently fast to ensure the transformation of the austenite phase into martensite in the steel. Cooling the component sufficiently rapidly to prevent the formation of excessively large ỳ may include cooling the component with a fast gas cool to a temperature of the component below about 600K.

The component may then be subjected to a temper heat treatment during which martensite tempering occurs. The component may be subjected to a temper heat treatment with temperatures between about 700K and 950K for at least two hours, such as in one embodiment for about four hours, and in some embodiments, for at least sixteen hours, at which martensite tempering can occur. In another embodiment, the component may be subjected to heat treatment at a temperature of between about 1000K and about 1150K for between about four to eight hours. This combined ageing and tempering heat treatment stage also allows the controlled production of unimodal γ̀ particles in the nickel superalloy. The properties of one or more of the materials forming the component may be enhanced by applying heat locally in an additional heat treatment stage or a prolongation of one or other of the two stages. The heat may be applied locally to at least one portion of the turbine component after subjecting the component to a temper heat treatment during which martensite tempering occurs. In particular, the nickel superalloy section may be subjected to localized heating for an additional 12 hours at between about 1000K and about 1100K.

After heating in the second stage and any subsequent or continued heating, the component may be cooled. The component may be cooled using any of the processes previously discussed or any appropriate process.

Example 1

The component may be formed from a nickel super alloy, such as UDIMET 720, and P92 steel. The first stage may include subjecting the component to a heat treatment of about 1350K for four hours and cooled with a fast gas cool to below about 600K. The second stage may include subjecting the component to a heat treatment of about 1077K for about eight hours and then cooled with air cooling.

Example 2

The component may be formed from a nickel super alloy portion, such as WASPALOY, an intermediate alloy portion, such as NIMONIC 901, and a E911 rotor steel portion. The first stage may include subjecting the component to a heat treatment of about 1323K for four hours and cooled with an oil quench. The second stage may include subjecting the component to a heat treatment of about 1023K for about four hours. The nickel super alloy may be may be locally heated for an additionally 12 hours at 1023K.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A method of heat treatment for forming a component of a turbine engine, comprising:

heating a component formed from a steel portion and a nickel superalloy portion such that the steel portion austinitizes and the nickel superalloy portion undergoes solutioning;

cooling the component to substantially prevent formation of gamma prime (ỳ); and subjecting the component to a temper heat treatment during which martensite tempering occurs.

2. The method of claim 1, wherein cooling the component comprises exposing the component to an air cool system.

3. The method of claim 1, wherein cooling the component comprises exposing the component to a fast gas cool.

4. The method of claim 1, wherein cooling the component comprises exposing the component to an oil quench.

5. The method of claim 1, wherein subjecting the component to a temper heat treatment comprises subjecting the component to temperatures between about 1000K and 1200K for at least two hours.

6. The method of claim 5, wherein subjecting the component to a temper heat treatment comprises subjecting the component to temperatures between about 1000K and 1200K for about four hours.

7. The method of claim 1, wherein subjecting the component to a temper heat treatment comprises subjecting the component to temperatures between about 800K and 950K for at least 16 hours.

8. The method of claim 1, further comprising applying heat locally to at least one portion of the turbine component after subjecting the component to a temper heat treatment during which martensite tempering occurs.

9. The method of claim 1, wherein heating a component formed from a steel portion and a nickel superalloy portion such that the steel portion austinitizes and the nickel superalloy portion undergoes solutioning comprises heating the component between about 1200K and 1500K for about 4 hours.

10. The method of claim 9, wherein cooling the component to prevent the excessive formation of gamma prime (ỳ) comprises a fast gas cool to a temperature of the component below about 600K.

11. The method of claim 10, wherein subjecting the component to a temper heat treatment during which martensite tempering occurs comprises heating the component to a temperature of between about 1000K and about 1150K for about eight hours.

12. The method of claim 11, further comprising air cooling the component after subjecting the component to temperatures of between about 1000K and about 1150K for about eight hours.

13. The method of claim 9, wherein cooling the component to prevent the excessive formation of ỳ comprises subjecting the component to an oil quench.

14. The method of claim 13, wherein subjecting the component to a temper heat treatment during which martensite tempering occurs comprises heating the component to a temperature of about 1000K and about 1150K for about four hours.

15. The method of claim 14, further comprising air cooling the steel portion of the component after subjecting the component to temperatures of between about 1000K and about 1150K for about four hours.

16. The method of claim 15, further comprising localized heating of the nickel superalloy section for an additional 12 hours at between about 1000K and about 1100K.

17. The method of claim 1, wherein the component further includes a portion formed from an intermediate alloy between the nickel superalloy and steel portions.

* * * * *